US006049984A

United States Patent [19]

McGehee

[11] Patent Number: 6,049,984

[45] Date of Patent: Apr. 18, 2000

[54] TOWER GUILLOTINE CIGAR CUTTER

[76] Inventor: William I. McGehee, 1264 Hermes Ave., Leucadia, Calif. 92024

[21] Appl. No.: 09/100,074

[22] Filed: Jun. 19, 1998

Related U.S. Application Data

[60] Provisional application No. 60/051,770, Jul. 7, 1997.

[51] Int. Cl.[7] ..... A24F 13/24

[52] U.S. Cl. ..... 30/113; 30/109; 131/248

[58] Field of Search ..... 30/109, 111, 113, 30/175, 182; 131/248, 250, 252

[56] References Cited

U.S. PATENT DOCUMENTS

| | | | |
|---|---|---|---|
| 1,086,463 | 2/1914 | Robbins | 30/113 |
| 4,160,318 | 7/1979 | Morel | 30/113 |
| 5,377,696 | 1/1995 | Goldman | 30/113 |
| 5,791,051 | 8/1998 | Schmidt | 30/113 |

FOREIGN PATENT DOCUMENTS

| | | |
|---|---|---|
| 2390115 | 1/1979 | France . |
| 106628 | 3/1899 | Germany . |

*Primary Examiner*—Hwei-Siu Payer
*Attorney, Agent, or Firm*—Brown, Martin, Haller & McClain

[57] ABSTRACT

A tower guillotine cigar end cutter has spaced twin towers with an upper crossbeam on a base, with a moveable cutter block and blade that is raised vertically by a rope, between the towers. Upon release, the cutting blade and block falls on a lower block having a channel for the blade, thereby cutting the end off a cigar. The cutter block has adjacent half-circle openings for receiving a cigar end. The moveable cutter block when raised by a rope is released when a release mechanism on the rope, contacts the crossbeam. A locking device locks the cutter block from being vertically moved from the lower block, when not in use.

10 Claims, 2 Drawing Sheets

TOWER GUILLOTINE CIGAR CUTTER

REFERENCE TO PRIOR PROVISIONAL APPLICATION

This application claims the benefit of Provisional Application No. 60/051,770 filed Jul. 7, 1997.

BACKGROUND OF THE INVENTION

The tower guillotine cigar and cutter of this invention is used to cut off the end of a cigar, or the burning end of a cigar, so the smoker can either light or relight the cigar at a later time. There are many ways in which the end of a cigar may be removed, which go all the way from biting off the end of the cigar to using a knife to cut off the cigar end, or to use hand-operated cutters, or to even use a guillotine cigar-end cutter, such as illustrated in the French patent to George Lalanne, No. 2,390,115, issued on Aug. 12, 1978. However, the operation of these known cutters are different from this invention, and are often very dangerous to use. Cutting off the end of a cigar when the cigar is lit, requires some dexterity. Using a knife to cut off the end of a cigar as well as using the hand-operated cutters, or even the known guillotine cutter, can damage and sometimes ruin the cigar, by excessively spreading the end of the cigar more than desired.

The use of the known guillotine-type cutters as disclosed in the French patent, are also dangerous in use because in such cutters, the guillotine blade is normally positioned in the upper suspended location and is ready for release by merely moving a lever. This can cause the cutting blade to be inadvertently dropped, with the blade then passing through the upper and lower block members that are positioned at the bottom of the guillotine. These blocks further form a fixed horizontal hole through which the cigar end is projected. It can be easily understood that when the blade is in the upper position, that any inadvertent release of the blade may remove a users fingers. This inadvertent problem particularly could affect an inexperienced user such as children, who might be enticed as an attractive nuisance, to insert their fingers into the continuous hole through which the end of the cigar is inserted for cutting. Further, the known guillotine cigar end cutters do not have any effective means of locking the guillotine blade from inadvertent operation, and especially when the cutting blade is in the raised position.

SUMMARY OF THE INVENTION

This invention provides a new and unique tower guillotine cigar end cutter which uses a pair of twin towers positioned on a base with a moveable cutting block and blade that moves vertically up and down between the towers. A crossbeam on the upper ends of the towers supports a pulley which is used to raise and lower the moveable cutting blade and block. The rope is connected to the cutting block and blade by a release mechanism that is easily connected and disconnected to the cutting block, and is automatically released when the release mechanism, raising the cutting block and blade, reaches the upper crossbeam member. This operation allows the cutting block and blade to be maintained in normal operation in the non-raised position. Further, an easily operated lock is used to lock the cutting block in the non-operating position. So when it is desired to use the cutter to cut the end off of a cigar, the cutting block is unlocked, and is then raised or pulled by the rope to the point where the releaseable mechanism contacts the crossbeam, releasing the cutting block and blade, and allowing the cutting blade to drop and cut off the end of the cigar. This provides an easy to use, safe release mechanism, that is easily locked so the cutting block cannot be raised or lowered.

It is therefore the object of this invention to provide a new and improved cutting mechanism for cutting off the end of a cigar.

It is another object of this invention to provide an improved guillotine-type cigar end cutter that is easy to use, operates in a new and distinctive manner, and provides safety features in use.

DESCRIPTION OF THE PREFERRED EMBODIMENT

Figure 1:
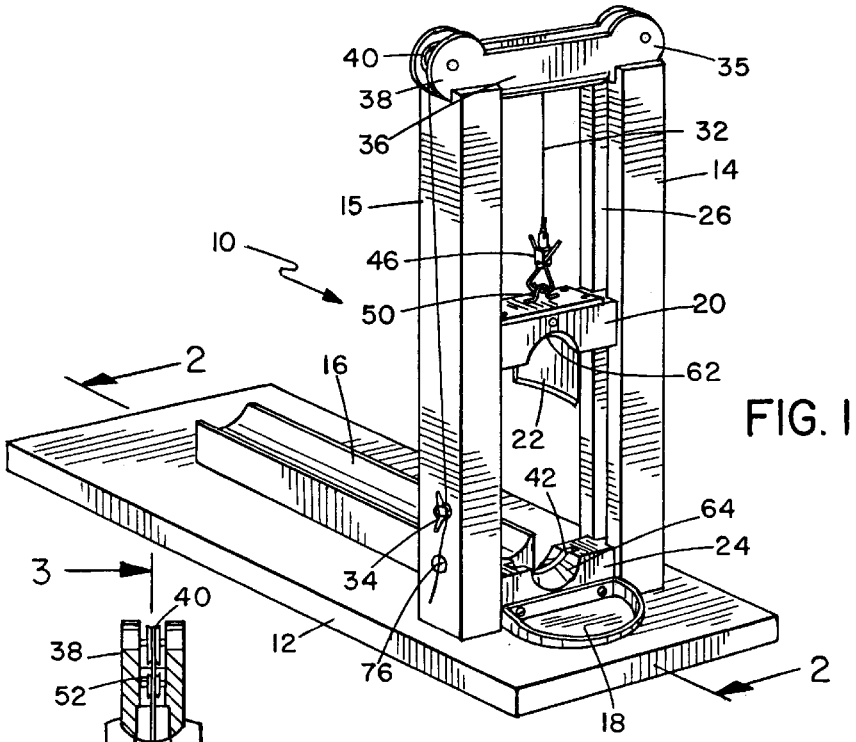
FIG. 1 is a perspective view from the left front of the guillotine cutter.

Referring to FIG. 1, the preferred embodiment of the present invention 10 comprises a base 12 on which is secured in vertical orientation, support columns or towers 14 and 15, with a bridging crossbeam 36. A landing block 24 is positioned between the two columns 14 and 15 and rests on base 12. Each of the columns 14 and 15 have vertical guide slots 26, which receive end guide projections that are at each end of the landing block 24. It is noted that the upper surface of the landing block 24 is flat, and has a slot 42 therein for receiving the cutting blade 22, and further has a curved semi-circular recess 64 on which the cigar rests.

Figure 5:
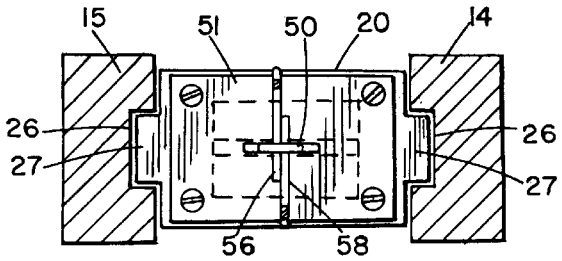
FIG. 5 is a sectional view taken on line 5—5 of FIG. 3.
Figure 6:
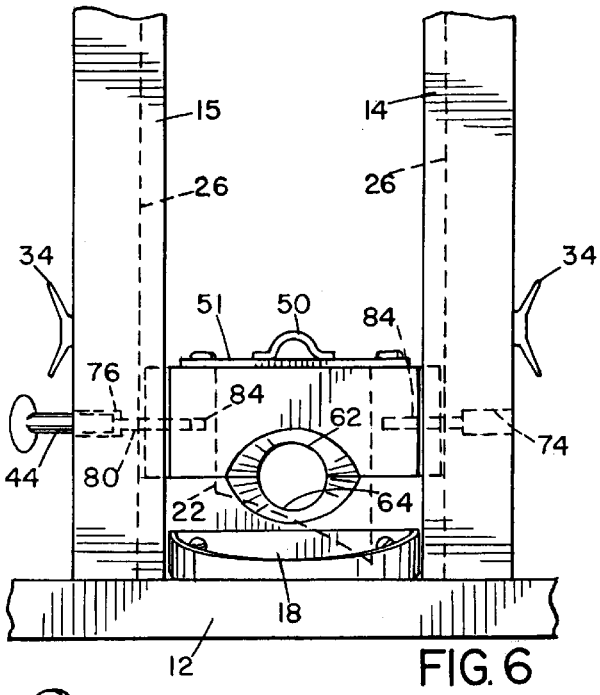
FIG. 6 is a front view of the lower portion of the structure, showing the cutting block down, with a security lock engaged.
Figure 7:
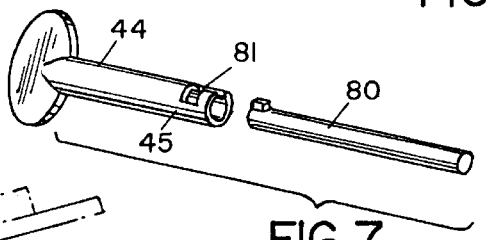
FIG. 7 is an enlarged view of the security locking pin and key.

A cutter block 20 has a flat lower surface that conforms with and rests on the upper surface of block 24. The guillotine cutting blade 22 is secured in the block 20, see FIGS. 2 and 3, and is held in position by rivet 21. The cutting block 20 has guide ends 27 which fit in the grooves 26 in columns 14 and 15. See FIG. 5. This provides aligned, vertical movement of block 20 so that when the cutting block 20 is dropped, blade 22 passes into slot 42 in the lower flat surface of block 24, cutting off the end of a cigar. Block 20 then rests on the upper flat surface of the landing block 24. The underside of the cutting block 20 has an arcuate opening 62 to accommodate the cut end of the cigar. A plate 51 is secured by screws to the upper surface of the cutter block 20, and bail 50 is secured or fastened to plate 51. A claw or tong-type releaseable connector 46 is secured to the end of the rope or line 32. Rope 32 is used to raise the cutting block 20 and cutting blade 22, to the crossbeam 36, where the releaseable connector 46 contacts a curved surface 60 in the manner to be described hereinafter, releasing the cutter block 20 and blade 115.

Crossbeam 36 has ends 35 and 38, with a circular outer configuration and a longitudinal slot as illustrated in FIGS.

2 and 3 with pulleys or sheaves 40 and 41 located at opposite ends for receiving, passing and supporting the rope or line 32. Also, a pair of pulleys or sheaves 52, are positioned adjacent opening 54 through the crossbeam, to provide aligned positioning of the end of the rope that is fixed to the releaseable connector 46. The end of line 32 can then be directed through either pulley 40 or 41, and its free end will then be connected to either sides of columns 14 or 15, and is secured by wrapping the end of the line around a wing cleat 34.

Figure 2:
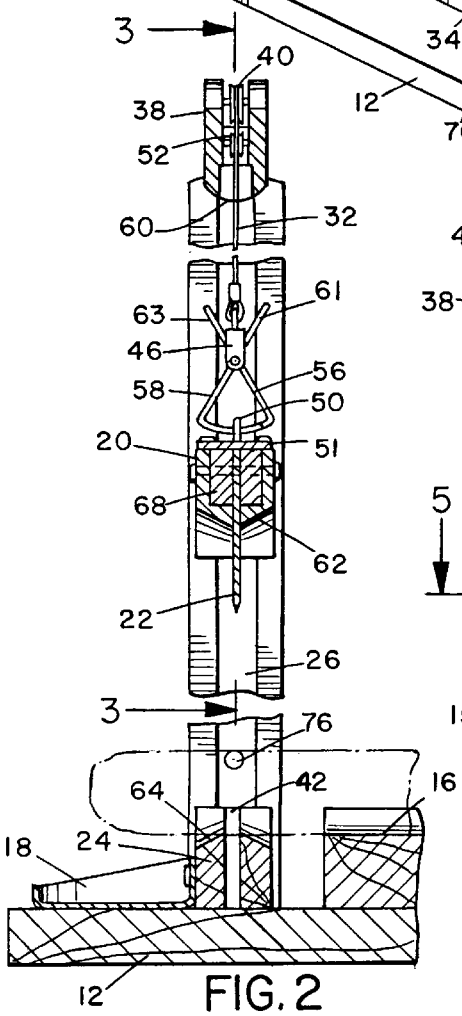
FIG. 2 is an enlarged sectional view taken on line 2—2 of FIG. 1.
Figure 3:
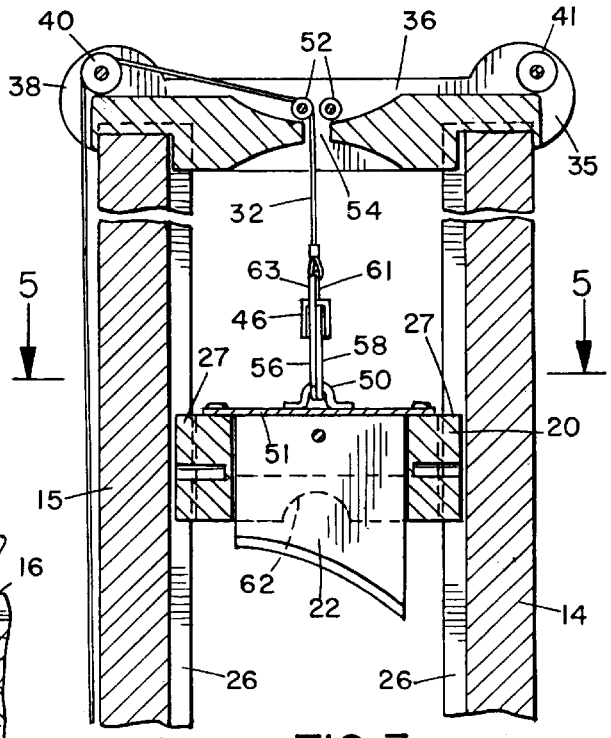
FIG. 3 is a sectional view taken on line 3—3 of FIG. 2.
Figure 4:
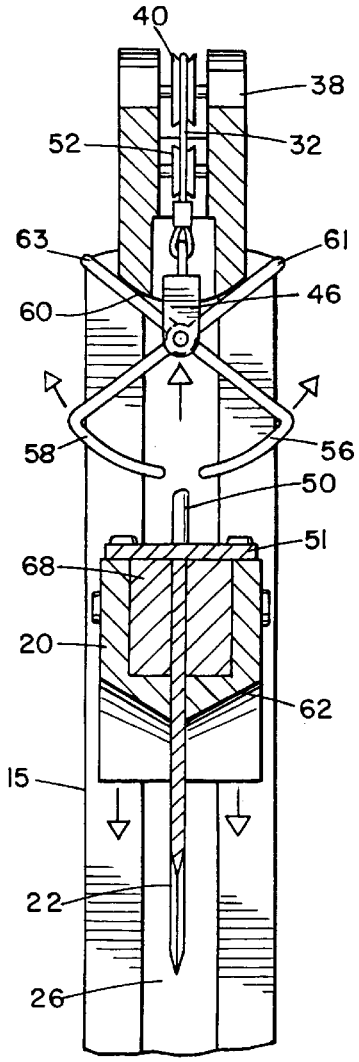
FIG. 4 is a further enlarged view of a portion of FIG. 2, showing the release of the cutting block.

The releaseable connector 46, has a pair of tongs 56 and 58 and rotatably connects the tongs to the U-shaped bail 50, see FIGS. 2 and 4. The L-shaped tongs 56, 58 each has a claw shaped configuration with the mid part of the upper portion having an intersecting connection that allows rotational movement in the manner of tongs, and rotatably connects the tongs to the U-shaped bracket. The upper arm portions 61 and 63 of the tongs can move towards each other in adjacent planes. The rotational clockwise and counterclockwise movement of the lower L-shaped tongs 56, 58 is limited by the upper U-shaped bracket end of connector 46 as shown in FIG. 2. When line 32 is pulled over the respective pulleys 52 and 40, see FIG. 3, the releaseable connector 46 is moved upwardly, where the upper arms 61 and 63 contact the arcuate lower surface 60 of the crossbeam 36. This forces arms 61 and 63 apart, and thus rotates the tong ends 56 and 58 outwardly, removing the tongs from bail 50 and the block 20 thus falls, causing the cutter blade 22 to pass through slot 42, cutting the cigar that may be positioned in the cigar holder 16, with the end projecting through the circular opening in the landing block 24 formed by the adjacent circular openings 62 and 64 of the cutting block 20. The dish 18 receives the cut end of the cigar. The cutting block 20 may have an inset weight 68 to ensure clean cutting.

A lock device 44, releaseably locks the cutting block 20 in the lower, rest position. Respective holes 74 and 76 in columns 14 and 15, interconnect with holes 84 in the sides of the cutting block 20. The locking pin 44 connects and disconnects by a known slot and groove rotating connection 81. Pin 44 is inserted for example in hole 76, and thus moves the extended, locking pin 80 into hole 84 of the block 20, thus locking block 20 from vertical movement. Then the housing end 45 of the locking pin 44, is rotated in a manner to disconnect from pin 80, leaving the locking pin 80 in position. This forms a lock and key arrangement for selectively locking and unlocking cutting block 20 in the normal, safe, resting position.

In Operation

In operation of the guillotine cutter for cutting tips off the ends of cigars, the locking key is rotated to remove the extension lock pin 80 from hole 84 in the cutting block 20. The operator of the cutter will then engage the lifting claw or tongs connector by slipping the two tongs 56, 58 under the loop of the bail 50. This is accomplished by hooking one of the tongs of the claw while keeping tension on the line attached to the connector 46. The other tong will then easily slide into the loop, at which time the operator will be able to lift the cutter block from the landing block 24 to the height where the operator may insert a cigar into the cutting area, locating the end of the cigar to wherever the desire is to cut the end off of the cigar. The operator may secure the end of the line 32 to one of the bits 34 on either side of the guillotine for convenience, if the cutting block 20 is to be left in the open position while selecting a cigar, for example. A cigar is laid in the support 16 with the end to be cut extending over the opening 64 in the landing block 24.

When the operator is ready to drop the cutting block 20, a gentle pull on the rope 32 is made until the lifting release connector 46, namely arms 61 and 63, hits the curved under surface 60 of the crossbeam 36, which will cause the arms 61 and 63 to separate, disengaging the tongs 56, 58 from the cutter block 20 and allowing it to fall, cutting the cigar at the point of the user's decision. It is noted that each of the openings 62 and 64 have outwardly widened surfaces to allow the end of the cigar to fall easily into the dish 18, and also not to damage the remaining part of the cigar adjacent the cut end.

When not in use, the locking pin 80 is inserted into the respective locking holes 84 with the end 44 of the tubular housing 45 abutting the shoulder of hole 76 locking the cutting block 20 in the lower position. The key end of the locking device 44 is then rotated, and removed from the hole, thereby preventing use by others of the guillotine cutting blade in a manner that might injure someone.

Figure 8:
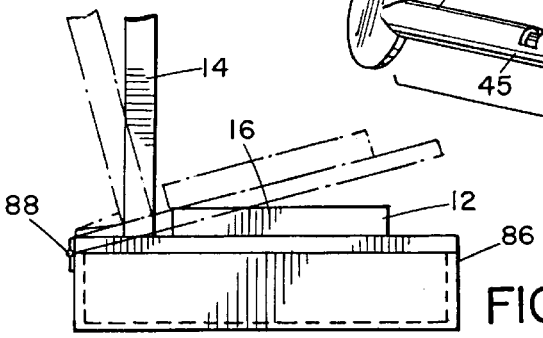
FIG. 8 is a side view, on a reduced scale, showing a storage box or humador incorporated into the base.

FIG. 8, illustrates the entire guillotine cutting device as supported by base 12, with base 12 forming the lid of a cigar box 86, which lid is pivoted on a normal piano hinge 88.

Having described a preferred embodiment of this inventions, it should be apparent to those skilled in the art that my invention may be modified in both arrangement and detail. Therefore the protection afforded my invention should be limited only in accordance with the scope of the following claims:

What is claimed is:

1. A guillotine cutter for cutting an end off of a cigar, comprising:

a base;

two vertically oriented, spaced towers supported by said base, at least one of said towers having a longitudinal guide slot;

a crossbeam interconnecting upper ends of said towers;

a pair of upper and lower blocks positioned between said towers with said upper block having means for moving vertically, each of said blocks having adjacent surfaces with half-circular openings that form a hole for receiving a cigar;

a cutting blade connected to said upper block for passing into said hole to cut the cigar;

a rope extending from said crossbeam for raising said upper block and said cutting blade; and a releasable connection interconnecting said rope to said upper block, said connection being disconnected when said releasable connection is raised by said rope to contact said crossbeam, thereby releasing said upper blade block to move said cutting blade to cut off the end of a cigar.

2. A guillotine cutter as claimed in claim 1, wherein:

said upper block having a side member projecting into said slot, for guiding said upper block in vertical movement between said towers.

3. A guillotine cutter as claimed in claim 1, wherein:

said lower block being secured in position at said base between said towers;

means for securing said upper block into a fixed position immediately adjacent said lower block that restrains said upper block from moving vertically.

4. A guillotine cutter as claimed in claim 3, wherein:

said securing means comprises a lock; and at least one of said towers and said upper block having holes for receiving said pin, thereby locking said upper block in a position immediately adjacent said lower block.

5. A guillotine cutter as claimed in claim 1, wherein:

said crossbeam having a vertical hole midway the length of said crossbeam, with pulley means on which said rope may be threaded through said hole, and be pulled vertically over said pulley means to raise said upper block; and said releasable connection coacting with a lower surface of said crossbeam actuating said release connection to release said rope connection to said upper block when said upper block is in a position adjacent said crossbeam.

6. A guillotine cutter as claimed in claim 5, wherein:

said lower surface having a concave recess;

said release connection having a pair of arms actuated to release the connection between said rope and said upper block; and said arms in contacting said recess are moved apart actuating the release connection.

7. A guillotine cutter as claimed in claim 6, wherein:

said release connection having a pair of pivoting tong members that interconnect to support said upper block, said arms for contacting said concave recess causing said arms to move in opposite directions, causing said tong ends to move in opposite directions and releasing the upper block to drop by gravity.

8. A guillotine cutter as claimed in claim 6, wherein:

said release connection comprising a pair of opposed tongs interconnected by a swivel connection midway their length, wherein said tongs move towards each other and connect to the upper block, and the upper end of said tongs being spread apart by contact with said concave recess to disconnect the release connection.

9. A guillotine cutter as claimed in claim 8, wherein:

a pair of spaced pulley sheaves one of said pulley sheaves connected adjacent said hole and the other of said pulley sheaves connected adjacent the outer edge of said crossbeam, whereby said rope passes through said hole and over said sheaves with one end extending downwardly along the side of one of said towers, whereby the rope may be pulled downwardly to raise the upper block to the disconnect position.

10. A guillotine cutter as claimed in claim 1, wherein:

said lower block having a longitudinal slot extending between the towers that is sized to receive a cutting edge of said cutting blade upon release and downward movement of said upper block.

* * * * *